United States Patent [19]

Jahn

[11] 4,328,996

[45] May 11, 1982

[54] CUTTER DRUM SUPPORT ARM FOR LONGWALL MINING MACHINE

[75] Inventor: Dieter Jahn, Bochum, Fed. Rep. of Germany

[73] Assignee: Gebr. Eickhoff Maschinenfabrik und Eisengiesserei m.b.H., Bochum, Fed. Rep. of Germany

[21] Appl. No.: 164,441

[22] Filed: Jun. 30, 1980

[30] Foreign Application Priority Data

Jul. 11, 1979 [DE] Fed. Rep. of Germany ..... 2927919

[51] Int. Cl.[3] ..... E21C 27/24

[52] U.S. Cl. ..... 299/43; 299/53

[58] Field of Search ..... 299/42–54, 299/75, 89

[56] References Cited

U.S. PATENT DOCUMENTS 438,446 10/1890 Richards ..... 299/89 X
2,801,092 7/1957 Joy ..... 299/75 X
4,154,480 5/1979 Lobbe ..... 299/54 X
4,223,950 9/1980 Barr ..... 299/89 X

FOREIGN PATENT DOCUMENTS 2155590 1/1973 Fed. Rep. of Germany ..... 299/75
2425828 11/1975 Fed. Rep. of Germany ..... 299/42

*Primary Examiner*—Ernest R. Purser
*Attorney, Agent, or Firm*—Thomas H. Murray

[57] ABSTRACT

A support arm for a cutter drum carried on a longwall mining machine characterized in being formed from two telescoping parts, at least one of which is movable axially relative to the other to change the length of the arm. This enables the mining machine to cut material from a coal seam with one support arm length and roadways at opposite ends of the seam face with longer support arm lengths without the necessity for raising the mining machine on its support tracks in the roadway areas or otherwise adjusting the vertical heights of the support arms.

10 Claims, 4 Drawing Figures

CUTTER DRUM SUPPORT ARM FOR LONGWALL MINING MACHINE

BACKGROUND OF THE INVENTION

As is known, a longwall mining machine traverses a coal seam or the like and has two rotating cutter heads at its opposite ends which cut and remove the coal and direct it onto a face conveyor extending along the path of travel of the mining machine. In the usual case, the mining machine is supported on tracks or guideways incorporated into the face conveyor. At opposite ends of the seam being mined are mine roadways which extend perpendicular to the face of the seam and are usually of a greater height than the seam itself. These roadways must also be cut by the rotating cutter heads carried on the mining machine.

In the past, longwall mining machines such as that shown in U.S. Pat. No. 4,085,974 have been provided with vertically-adjustable support arms for the cutter drums so as to enable the mining machine to shear a seam up to its full thickness in a single cut and to also cut the roadway at the opposite ends of the face. Vertically-adjustable support arms of this type, however, increase the overall length of the longwall mining machine and impair its maneuverability underground.

It is also possible, of course, to elevate the opposite ends of the track traversed by the longwall mining machine such that the entire machine is elevated in the roadway areas. This enables cutter drum support arms of ordinary length to be used to clear both the roof and the floor of the roadway. An arrangement of this type, for example, is shown in German Patent Specification No. 2,324,101. A machine track which rises similarly to a ramp at the ends of the face area, however, makes it considerably more difficult to load the cut material accumulating in these areas.

Drifting or heading machines having swing arms in the form of two tubular elements arranged one inside the other for telescopic movement form part of the prior art (German Auslegeschrift No. 1,221,172).

SUMMARY OF THE INVENTION

In accordance with the present invention, axially-adjustable support arms for the cutter drums of a longwall mining machine are provided such that the lengths of the arms can be altered. In this way, the mining machine can cut the seam with the support arms adjusted to a relatively short length and can cut the roadways at opposite ends of the seam with the support arms adjusted to longer lengths. All of this can be accomplished without any structural modification of the track for the mining machine and without increasing its overall length.

Advantageously, the support arms are formed in two parts, one of which carries a cutter drum and the other of which is mounted on the machine body for pivotal movement about an axis extending perpendicular to the axis of the support arm. The outer support arm part which carries the cutter drum is movable axially relative to the inner support arm part and is provided with means for moving it toward or away from the inner part. The outer support arm part which carries the cutter drum can be mounted for movement on guide bars carried on the inner part; however it is preferable that the two support arm parts be guided one within the other for telescopic axial movement without relative rotation.

The two support arm parts have at least one doubleacting fluid cylinder adapted to move the outer cutter drum-carrying part inwardly or outwardly with regard to the inner arm part. In one embodiment of the invention, two hydraulic cylinders are provided on opposite sides of the support arm to move the outer arm part inwardly or outwardly with respect to the inner arm part. Carried within each support arm is a drive shaft having a bevel gear at each end for transmitting rotary power from the mining machine to the cutter drum. This shaft is advantageously formed from two coaxial parts which can move axially relative to each other by way of a splined connection or the like. One of the shaft elements can be provided with an internal fluid cylinder adapted to separate or move together the two shaft parts as well as the two parts of the support arm itself.

The above and other objects and features of the invention will become apparent from the following detailed description taken in connection with the accompanying drawings which form a part of this specification, and in which.

Figure 4:
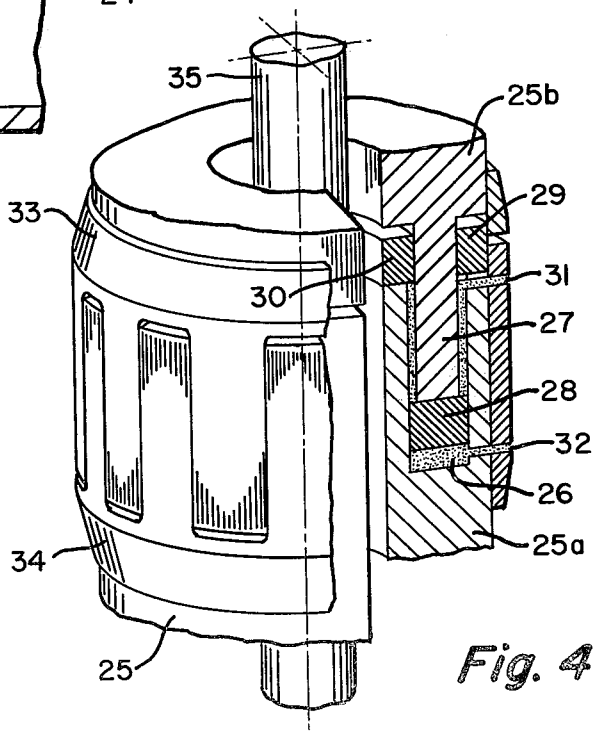
Figure 3:
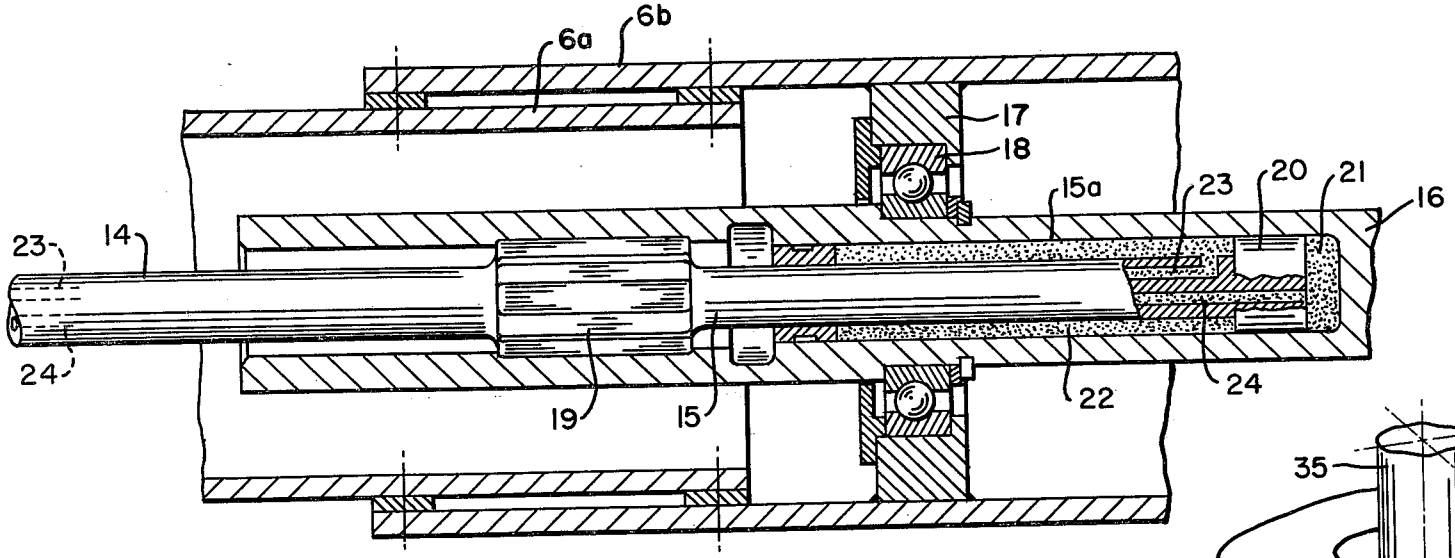

FIG. 3 is a cross-sectional view of another embodiment of the invention wherein relative axial movement between two telescopic support arm parts is effected by means of a fluid cylinder carried within an extensible drive shaft of the support arm; and FIG. 4 is a perspective view of still another embodiment of the invention in which an annular piston surrounding a drive shaft is employed for imparting relative axial movement between support arm parts.

Figure 1:
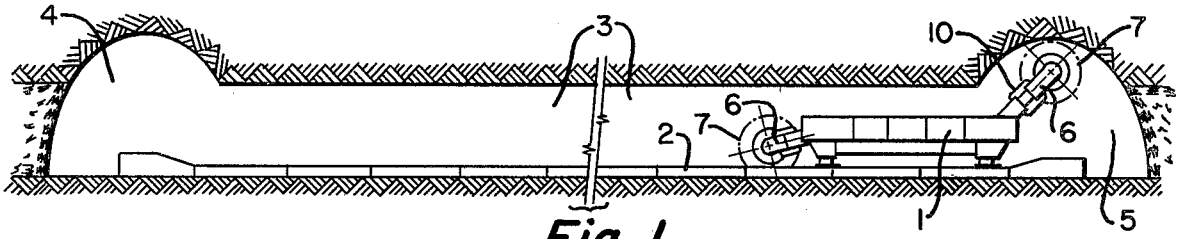
FIG. 1 is a schematic illustration of a double longwall mining machine provided with the support arms of the invention and which is movable over a face conveyor, the machine being shown while cutting a roadway at one end of the face area of a seam.

With reference now to the drawings, and particularly to FIG. 1, there is shown a longwall mining machine 1 having arms 6 at its opposite ends which carry at their outer extremities cutter drums 7. As will be seen, the arms 6 are adjustable in length and are pivotally connected to the mining machine 1 about pivot axes extending perpendicular to the longitudinal axes of the arms. Extending through each arm 6 is a drive mechanism, hereinafter described, for transmitting rotary power from a motor or motors on the mining machine frame to the cutter drums 7.

The mining machine 1 is adapted to traverse a face conveyor 2 extending along the face 3 of a mineral seam being mined. As the mining machine traverses the conveyor 2, which can be moved toward the face after each longwall cut, the two cutter drums 7 cut and remove a layer of the mineral, the cut material falling onto the face conveyor 2 where it is conveyed to a transverse conveyor extending along the floor of a mine roadway 4 or 5 formed at opposite ends of the face 3. The roadways 4 and 5 must have a greater height than the seam of material being mined.

In accordance with the present invention, the two support arms 6 for the cutter drums 7 are adjustable in length such that the right-hand arm shown in FIG. 1, for example, can be lengthened to cut the roadway 5 completely as the right cutter drum support arm 6 pivots about the mining machine frame. Similarly, the left-hand roadway 4 can be cut by adjusting the length of the left cutter drum support arm 6 without the necessity for elevating the face conveyor 2 at its end or otherwise providing a vertical adjustment for the pivot points about which the arms 6 rotate.

Figure 2:
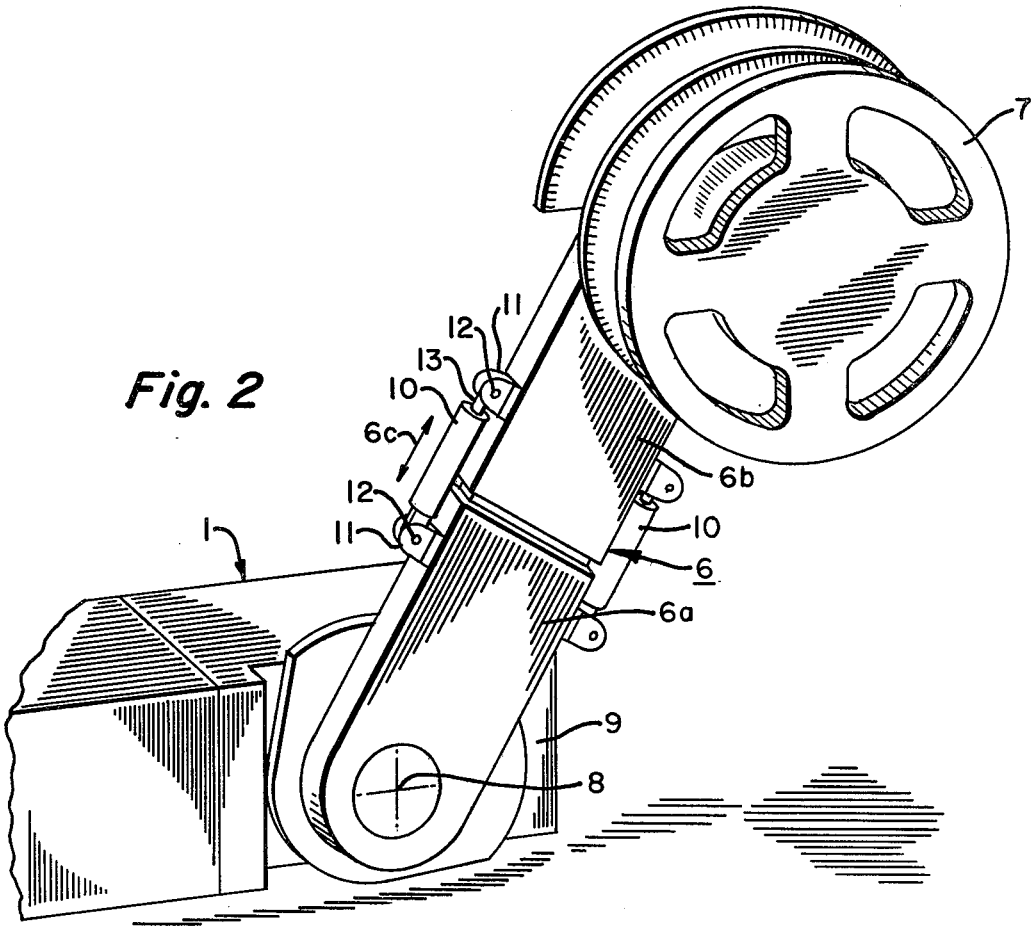
FIG. 2 is a perspective view of a cutter drum support arm according to the invention employing two external fluid cylinders for adjusting the length of the arm.

One embodiment of the invention is shown in FIG. 2 wherein the support arm 6 comprises an inner support arm part 6*a* pivotally mounted on a mining machine head 9 for rotation about an axis 8 which extends perpendicular to the longitudinal axis of the support arm. The outer support arm part 6*b* is telescopically received within the inner arm part 6*a* and is movable inwardly or outwardly with respect to part 6*a* along the direction of arrow 6*c*. In the embodiment of FIG. 2, movement along the direction of arrow 6*c* is produced by two double-acting hydraulic cylinders 10 disposed on opposite sides of the support arm parts 6*a* and 6*b*. The end of the cylinder 10 opposite its projecting piston rod 13 is connected to a pivot pin 12 extending between the legs of a bifurcated lug 11 secured to the inner arm part 6*a*; while the piston rod itself is connected through a similar pivot pin 12 to a second bifurcated lug 11 secured to the outer arm part 6*b*. The two cylinders 10 are supplied with fluid under pressure, preferably liquid under pressure, by hydraulic circuits, not shown, emanating from the mining machine 1. They respond to the pressure exerted by such fluid to move the outer arm part 6*b* outwardly or inwardly with respect to the inner arm part 6*a*, thereby adjusting the position of the cutter drum 7, with or without a corresponding pivoting movement of the support arm. The cutter drum 7 can be provided with an internal drive motor, not shown, carried on the outer arm part 6*b*, or it can be connected through transmission means carried within the arm 6 to a drive motor within the mining machine 1. It will be apparent, of course, that instead of providing cylinders 10 on the outside of the arm parts 6*a* and 6*b*, the cylinders can also be positioned interiorly of the arm parts which are hollow in construction.

Another embodiment of the invention is shown in FIG. 3 wherein the two support arm parts 6*a* and 6*b* can be moved axially relative to one another by means of a single fluid cylinder inside the support arm. Extending through the support arm is a drive shaft for the cutter drum 7 formed from two parts 14 and 16, one of which can move axially relative to the other by virtue of a splined connection 19 between the two. The drive shaft is mounted in a bearing 18 which, in turn, is carried on a bulkhead 17 extending transversely of the arm part 6*b*. Beyond the spline 19 on the shaft part 14 is an extension 15 which carries at its forward end a piston 20 reciprocable within a cylinder or bore 15*a* formed in part 16. Chamber 21 on one side of the piston 20 is connected to a passageway 24 extending through the shaft part 14. Similarly, chamber 22 formed on the other side of the piston is connected to a passageway 23 also extending through the shaft part 14. The passageways 23 and 24 are, in turn, connected through suitable valving to a hydraulic pump and a hydraulic reservoir such that by suitable actuation of the valving, either chamber 21 and 22 can be pressurized to cause the two shaft parts 14 and 16 to move together or apart, depending upon requirements. Since the transverse bulkhead 17 is connected to part 6*b*, movement of the piston 20 within the cylinder 15*a* will also cause telescoping movement between the support arm parts 6*a* and 6*b*. In the usual case, the shaft parts 14 and 16 will carry at their extremities bevel gears which, in turn, mesh with bevel gears connected to a drive motor and the cutter drum 7, respectively.

In FIG. 4, still another embodiment of the invention is shown wherein a cutter drum support arm 25 is again formed of two telescoping parts 25*a* and 25*b*. Part 25*a* has formed therein an annular chamber 26 having a depth greater than the travel of the support arm part 25*b*. Part 25*b* is provided with an annular extension 27 of reduced cross-sectional area which extends into the annular chamber 26 and is connected at its inner end to an annular piston 28 reciprocable within the chamber 26. As shown, the annular extension 27 extends through two annular sealing rings 29 and 30. The arrangement forms two cylinder chambers separated by the piston 28. One chamber is connected to passageway 31 and the other is connected to passageway 32, these passageways being connected through suitable valving to a hydraulic pumping system such that one side or the other of the piston 28 can be pressurized to produce relative movement between support arm parts 25*a* and 25*b*. The respective arm parts are provided with annular covers 33 and 34 which have interleaved fingers which permit relative axial movement between the arm parts while preventing relative rotary movement therebetween. A drive shaft 35, similar to that shown in FIG. 2, can be varied in length by means of a splined connection or the like and is disposed concentrically with the arm parts 25*a* and 25*b*.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. In a longwall mining machine adapted to traverse a face conveyor extending along a mine face of a mineral seam, a support arm pivotally mounted at its inner end to the mining machine about an axis extending perpendicular to the length of the arm and perpendicular to the direction of movement of the mining machine in cutting a seam, a cutter drum carried at the outer end of the arm for rotation about an axis extending parallel to said first-mentioned axis, and means for adjusting the length of said arm.

2. The support arm of claim 1 wherein the arm is formed in two parts, one of which carries said cutter drum and the other of which is pivotally mounted on the mining machine, said one arm part being movable lengthwise relative to said other arm part, and means for producing relative lengthwise movement between said parts.

3. The support arm of claim 2 wherein the means for producing relative movement between said arm parts comprises double-acting hydraulic cylinder means.

4. The support arm of claim 3 wherein said hydraulic cylinder means comprises a pair of hydraulic actuators on opposite sides of said arm, each actuator having a cylinder portion connected to one arm part and a piston rod connected to the other arm part.

5. The support arm of claim 2 wherein one of said support arm parts is provided with an annular extension, an annular cavity formed in said extension, a cylindrical extension on the other arm part extending into said annular cavity, and an annular double-acting piston reciprocable within said annular cavity and connected to said cylindrical extension.

6. The support arm of claim 2 wherein one of said arm parts is telescopically carried in the other arm part.

7. The support arm of claim 6 including a drive shaft extending through said arm for transmitting rotary power from the mining machine to said cutter drum, said drive shaft being formed from two coaxial parts which can move axially relative to each other.

8. The support arm of claim 7 wherein said coaxial drive shaft parts are interconnected by means of a splined connection.

9. The support arm of claim 7 including a cylinder formed in one of said drive shaft parts, said cylinder being coaxial with said drive shaft, and a piston reciprocable within said cylinder and connected to said other drive shaft part whereby fluid under pressure admitted to said cylinder on one side of said piston will cause said drive shaft parts to move apart while fluid under pressure exerted on the other side of said piston will cause said drive shaft parts to move together.

10. The support arm of claim 9 including a connection between one of said drive shaft parts and its associated support arm part thereby movement of said drive shaft parts toward each other will cause said support arm parts to move together and vice versa.

* * * * *